US011638494B2

(12) United States Patent
Deng

(10) Patent No.: US 11,638,494 B2
(45) Date of Patent: May 2, 2023

(54) ADJUSTABLE SLEEPING PILLOW THAT BALANCES THE BODY PRESSURE RATIO

(71) Applicant: Xiu Deng, Shenzhen (CN)

(72) Inventor: Xiu Deng, Shenzhen (CN)

( * ) Notice: Subject to any disclaimer, the term of this patent is extended or adjusted under 35 U.S.C. 154(b) by 517 days.

(21) Appl. No.: 15/561,341

(22) PCT Filed: Oct. 31, 2016

(86) PCT No.: PCT/CN2016/103940

§ 371 (c)(1),
(2) Date: Oct. 1, 2018

(87) PCT Pub. No.: WO2017/076245

PCT Pub. Date: May 11, 2017

(65) Prior Publication Data

US 2019/0021526 A1 Jan. 24, 2019

(30) Foreign Application Priority Data

Nov. 5, 2015 (CN) ..... 201520877861.8
Oct. 17, 2016 (CN) ..... 201621132320.3

(51) Int. Cl.
*A47G 9/10* (2006.01)
*B68G 7/06* (2006.01)

(52) U.S. Cl.
CPC ..... *A47G 9/1081* (2013.01); *B68G 7/06* (2013.01)

(58) Field of Classification Search
CPC ..... A47G 9/1081; A47G 9/1027
See application file for complete search history.

(56) References Cited

U.S. PATENT DOCUMENTS 3,757,365 A * 9/1973 Kretchmer ..... A47G 9/10 5/636
4,998,309 A * 3/1991 Tesch ..... A47G 9/10 5/636

(Continued)

*Primary Examiner* — David R Hare
*Assistant Examiner* — Ifeolu A Adeboyejo
(74) *Attorney, Agent, or Firm* — Li & Cai Intellectual Property (USA) Office

(57) ABSTRACT

The present invention provides a kind of sleeping pillow complying with the spinal medical theories, including the pillow case and fillers. The space enclosed by the said pillow case is divided into the isolated head bearing area and neck bearing area, and the said head bearing area is divided into the middle dented face-up sleeping head bearing area and the side sleeping head bearing area whose sides are higher. The said neck bearing area is divided into the face-up sleeping neck bearing area set in the middle and the side sleeping neck bearing area set on both sides of the said face-up sleeping neck bearing area. The height of the said the side sleeping neck bearing area is not lower than that of the said face-up sleeping neck bearing area. The adjustable sleeping pillow in the present invention that makes the body pressure balanced has a standalone head bearing area and neck bearing area, which can avoid random movement of fillers to ensure the stability of the pillow shape; moreover, the head bearing area is provided with the face-up sleeping and side sleeping bearing areas at different heights, which make a human head feel naturally comfortable while a person is sleeping. The neck bearing area can make the neck closely fit to the sleeping pillow during side sleeping and face-up sleeping giving the neck a mild support force.

6 Claims, 10 Drawing Sheets

(56) References Cited

U.S. PATENT DOCUMENTS

| | | | | |
|---|---|---|---|---|
| 7,080,421 | B1 * | 7/2006 | Delfs | A47G 9/0207 5/502 |
| 7,353,773 | B2 * | 4/2008 | Lamstein | A01K 1/0157 119/28.5 |
| 7,467,432 | B2 * | 12/2008 | Brogan | A47G 9/10 5/636 |
| 9,167,922 | B1 * | 10/2015 | Holbrook | A47G 9/10 |
| 9,474,396 | B2 * | 10/2016 | Russell | A47G 9/10 |
| 2013/0031723 | A1 * | 2/2013 | Parnham | A47G 9/1081 5/645 |
| 2014/0196214 | A1 * | 7/2014 | DuPre | A47G 9/0253 5/644 |
| 2016/0166092 | A1 * | 6/2016 | Alletto, Jr. | A47G 9/1036 5/638 |
| 2016/0213176 | A1 * | 7/2016 | Clemente, II | A47G 9/1081 |
| 2016/0270566 | A1 * | 9/2016 | Soreano | A47C 27/124 |
| 2017/0099967 | A1 * | 4/2017 | Holbrook | A47G 9/10 |
| 2019/0313816 | A1 * | 10/2019 | Miyamoto | A47G 9/1036 |
| 2020/0100606 | A1 * | 4/2020 | Ganji | A61F 5/56 |
| 2020/0154912 | A1 * | 5/2020 | Del Balso | A47G 9/1027 |
| 2021/0093106 | A1 * | 4/2021 | Gray, III | A47G 9/1036 |

* cited by examiner

ADJUSTABLE SLEEPING PILLOW THAT BALANCES THE BODY PRESSURE RATIO

TECHNICAL FIELD

The present invention involves the technical field of pillows, and especially involves a kind of sleeping pillow complying with the spinal medical theories.

BACKGROUND TECHNOLOGIES

As people have higher and higher demand for sleeping quality, they have more and more awareness of protection of their cervical vertebras. The sleeping pillow designed according to the spinal medical theory becomes more and more popular for them. The kernel of this kind of pillow is that the head sleeping area and the corresponding neck sleeping area must conform to the curvature of people in their natural physiological state. The sleeping modes are generally divided into the face-up sleeping and the side sleeping. However, the human physiological curves when they are face-up sleeping are different from those while they are side sleeping.

The design of sleeping pillows in modern technology does not conform to human physiological curves. When face-up sleeping or the side sleeping is applied, the neck contacts the sleeping pillow. The congenial structure design makes fillers unable to flow and deform so as to adapt to human body natural comfortable state, and makes people have bad experience in actual operation process, so the acceptance is low.

CONTENT IN THE INVENTION

The technical issue to be resolved by the present invention is to provide a kind of sleeping pillow complying with the spinal medical theories.

A technical solution provided to resolve its technical issue in the present invention is:

A kind of sleeping pillow complying with the spinal medical theories includes the pillow case, the fillers placed in the said pillow case, with its characteristics as: the said pillow case includes the upper layer cloth and the lower layer cloth. The space enclosed by the said pillow case includes the head bearing area located on the upper side of the pillow case and the neck bearing area located on the lower side of the pillow case. The said head bearing area includes the face-up sleeping head bearing area located in the middle and the side sleeping head bearing area located on two sides. The said neck bearing area includes the face-up sleeping neck bearing area located in the middle and the neck bearing area located on two sides.

Preferably, head bearing area includes face-up sleeping head bearing area and the side sleeping head bearing area, the said face-up sleeping head bearing area is independent with the said the side sleeping head bearing area. The side sleeping head bearing area on both sides of the pillow case is interpenetrated; the said neck bearing area includes the face-up sleeping neck bearing area located in the middle of the pillow case and the side sleeping neck bearing area located on two sides.

Preferably, the space enclosed by the pillow case is provided with the connecting cloth sewed between the upper layer cloth and the lower layer cloth. The said pillow case forms independent face-up sleeping neck bearing area with the effect of pulling force of the connecting cloth, and the said the side sleeping head bearing area and the side sleeping neck bearing area are interpenetrated.

Preferably, the space enclosed by the pillow case is provided with the vertical partition cloth sewed between the said upper layer cloth and the lower layer cloth. The said pillow case forms independent head bearing area and neck bearing area with the effect of pulling force of vertical partition cloth.

Preferably, neck bearing area is provided with the connecting cloth sewed between the upper layer cloth and the lower layer cloth. The said pillow case forms the standalone face-up sleeping neck bearing area and the side sleeping neck bearing area with the pulling force of the connecting cloth.

Preferably, head bearing area and neck bearing area is provided with zipper opening with pocket style adjusting filler filling amount.

Preferably, one side of the pillow case is adducted forming a radian shoulder pad.

Preferably, head bearing area and neck bearing area are isolated. The said head bearing area is divided into the face-up sleeping head bearing area dented in the middle and the side sleeping head bearing area whose both sides are higher. The said neck bearing area is divided into the face-up sleeping neck bearing area set in the middle and the side sleeping neck bearing area set on both sides of the said face-up sleeping neck bearing area. The height of the said the side sleeping neck bearing area is no lower than the said face-up sleeping neck bearing area.

Preferably, the pillow case includes the jointly sewed upper layer cloth and lower layer cloth. There is vertical partition cloth sewed between he said upper layer cloth and lower layer cloth. The said head bearing area and neck bearing area is separated by the said vertical partition cloth. The said head bearing area is provided with several pieces of connecting cloth connecting the said upper layer cloth and lower layer cloth. The said head bearing area forms the said face-up sleeping head bearing area and the side sleeping head bearing area with the effect of pulling force of the said connecting cloth.

Preferably, neck bearing area is provided with at least two pieces of vertical subsection cloth that is totally isolated or partly isolated. The said neck bearing area forms the face-up sleeping neck bearing area and the side sleeping neck bearing area with the effect of pulling force of the said vertical subsection cloth.

Preferably, the pillow case includes the jointly sewed upper layer cloth and lower layer cloth. The said head bearing area and neck bearing area are located in the space formed by sewing the said upper layer cloth and lower layer cloth. The said head bearing area is provided with head support bag, and the said head support bag has the face-up sleeping head support section dented in the middle and the side sleeping head support section whose both sides are higher. The said face-up sleeping head support section corresponds with the said face-up sleeping head bearing area, and the said the side sleeping head support section corresponds with the said the side sleeping head bearing area.

Preferably, vertical partition cloth is sewed between the upper layer cloth and the lower layer cloth. The said head bearing area and neck bearing area are separated by the said vertical partition cloth. The said neck bearing area is provided with at least two pieces of totally isolated or partly isolated vertical subsection cloth. The said neck bearing area forms the face-up sleeping neck bearing area and the side sleeping neck bearing area with the effect of pulling force of the said vertical subsection cloth.

Preferably, the pillow case can be used as an inner container only.

Preferably, height adjusting cushion is also set between the lower layer cloth and the bottom layer cloth.

Preferably, two sides of the upper layer cloth and the lower layer cloth are sewed with vertical cloth.

The beneficial results of the present invention are:

It is a kind of sleeping pillow complying with the spinal medical theories in the present invention. The standalone face-up sleeping head bearing area separates the side sleeping head bearing area so that the face-up sleeping head bearing area and the side sleeping head bearing area will not interfere with each other. The independent neck bearing area and head bearing area, or interpenetrated neck bearing area and head bearing area can satisfy the adaptable demand for spinal physiological curves of different human bodies while they are face-up sleeping or the side sleeping providing the neck and head with warm support, maintaining neck's normal physiological curves and physiological heights.

DESCRIPTION OF FIGURES

In order to make more clear description of technical solutions in the present invention embodiments, we will make a brief description of the figures required to be used in the description of the embodiments.

SPECIFIC IMPLEMENTATION MODE

The following is the clear and complete description of the conception, specific structure and technical results of the present invention in the light of embodiments and figures so that people will have an adequate understanding of the purposes, plans and results of the present invention. What should be described is that when there is no conflict, the embodiments and characteristics therein in this application can be combined. In addition, the description such as upper, lower, left and right used in the present invention only relate to the relationships of locations of different component parts in the present invention as set out in the figures.

Figure 1:
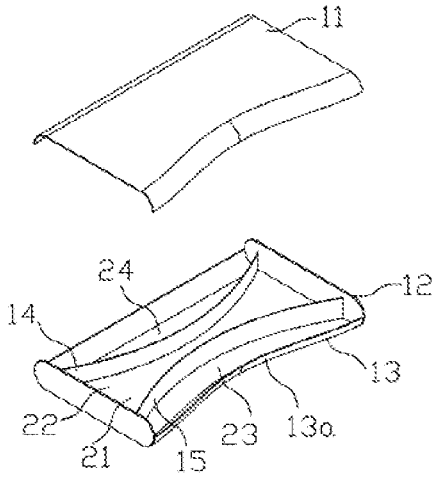
FIG. 1 is the inner structure diagram of the first implementation mode for a kind of sleeping pillow complying with the spinal medical theories in the present invention.

FIG. 1 is the inner structure diagram of the first implementation mode for a kind of sleeping pillow complying with the spinal medical theories in the present invention. With reference to FIG. 1, the sleeping pillow contains the upper layer cloth 11, the lower layer cloth 13, a pair of vertical walls 12 located on both sides of the sleeping pillow, the said vertical wall 12 can ensure the vertical shape of both sides of the sleeping pillow, the said upper layer cloth 11, lower layer cloth 13, the space jointly enclosed by the vertical wall 12 is the pillow case; the pillow case is provided with the connecting cloth 14 and connecting cloth 15 sewed in the upper layer cloth 11, the lower cloth 13 and the vertical wall 12. The said pillow case forms independent face-up sleeping head bearing area 24 and face-up sleeping neck bearing area 23 with the effect of pulling force of the connecting cloth 14 and the connecting cloth 15. Two sides of the said face-up sleeping head bearing area 24 and the said face-up sleeping neck bearing area 23 are interpenetrated side sleeping head bearing area 22, the side sleeping neck bearing area 21, the said the side sleeping head bearing area 22 and the side sleeping neck bearing area 21 are interpenetrated, and the lower parts of the said neck bearing area and the head bearing area are provided with height adjusting cushions, so comfortable sleeping heights can be adjusted as required.

The said sleeping pillow is in the symmetrical structure, and the abovementioned inner structure design of the sleeping pillow enables fillers of the face-up sleeping area and the side sleeping area to be independent without being interfered with. The most comfortable head bearing area and the neck bearing area can be provided in different sleeping modes; the said face-up sleeping head bearing area 24, the side sleeping head bearing area 22, the side sleeping neck bearing area 21 and or face-up sleeping neck bearing area 23 are provided with zipper openings filled with pocket style adjusting fillers (not shown in the figure). Appropriate amount of fillers can be filled based on different demands to adjust the height of the sleeping pillow and the softness and hardness of the sleeping pillow. While basic physiological curves of human body are ensured, fillers can relax and deform in their respective areas or transfixion areas forming comfortable occipital areas; for the fillers filled in the side sleeping area and the face-up sleeping area, they can be the same kind of fillers, or different kinds of fillers can be selected at different parts as required; the lower side of the sleeping pillow is extracted forming an arc should pad 13*a*. When human body is in the face-up sleeping mode, the sleeping pillow conforms to the physiological structure of human shoulders and neck offering people more comfortable operation experience. Furthermore, this sleeping pillow can also be used as a general inner container.

Figure 2:
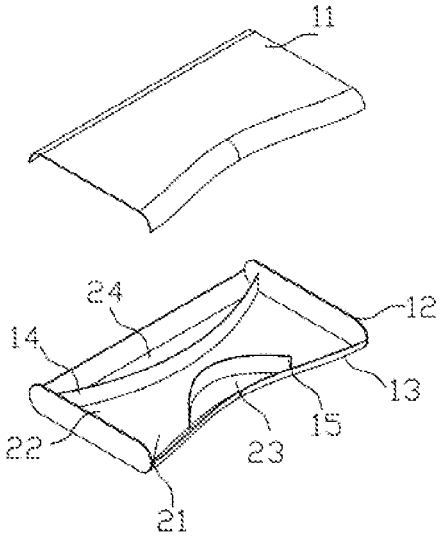
FIG. 2 is the inner structure diagram of the second implementation mode for a kind of sleeping pillow complying with the spinal medical theories in the present invention.

FIG. 2 is the inner structure diagram of the second implementation mode for a kind of sleeping pillow complying with the spinal medical theories in the present invention. With reference to FIG. 2, the difference between this implementation mode and the first implementation mode lies in that the connecting cloth 15 fails to be sewed with the vertical wall 12, with other structures the same as those of the first implementation mode, so there will be no repeated description. In this implementation mode, the said pillow case forms standalone face-up sleeping neck bearing area 23 with the effect of pulling force of the connecting cloth 15. The said face-up sleeping neck bearing area 23 does not contact the vertical wall 12, and the connecting cloth 15 is sewed at the upper layer cloth 11 and the lower layer cloth 13. This implementation structure has reduced difficulty in production and processing and saved costs.

Figure 3:
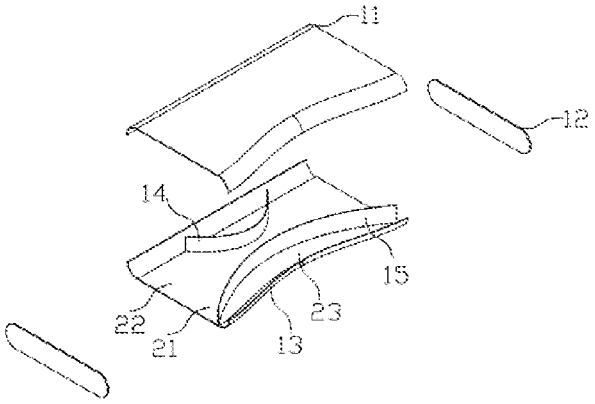
FIG. 3 is the inner structure diagram of the third implementation mode for a kind of sleeping pillow complying with the spinal medical theories in the present invention.

FIG. 3 is the inner structure diagram of the third implementation mode for a kind of sleeping pillow complying with the spinal medical theories in the present invention. The difference between this implementation mode and the first implementation mode lies in that the connecting cloth 14 fails to be sewed with the vertical wall 12, with other structures the same as those of the first implementation mode, so there will be no repeated description. In this implementation mode, the said pillow case forms standalone face-up sleeping neck bearing area 23 via the connecting cloth 14 under the effect of pulling force. The said neck bearing area 23 does not contact the vertical wall 12. The connecting cloth 14 is sewed at the upper layer cloth 11 and the lower layer cloth 13, thus having reduced difficulty in production and processing and saved costs.

Figure 4:
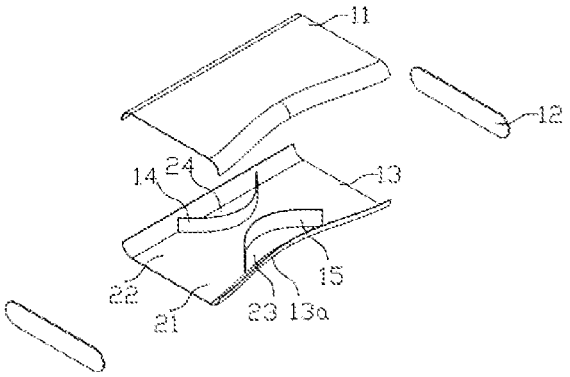
FIG. 4 is the inner structure diagram of the fourth implementation mode for a kind of sleeping pillow complying with the spinal medical theories in the present invention.

FIG. 4 is the inner structure diagram of the fourth implementation mode for a kind of sleeping pillow complying with the spinal medical theories in the present invention. The difference between this implementation mode and the first implementation mode lies in that the connecting cloth 14 and the connecting cloth 15, whose length is shortened, fail to be sewed with the vertical wall 12, with other structures the same as those of the first implementation mode, so there will be no repeated description. In this implementation mode, the said pillow case forms standalone face-up sleeping head bearing area 24 and face-up sleeping neck bearing area 23 by the connecting cloth 14 and the connecting cloth 15 under the pulling force. The said face-up sleeping head bearing area 24 and face-up sleeping neck bearing area 23 do not contact the vertical wall 12, and connecting cloth 14 and connecting cloth 15 are sewed at upper layer cloth 11 and lower layer cloth 13, thus reducing difficulty in production and processing and saving costs.

Figure 5:
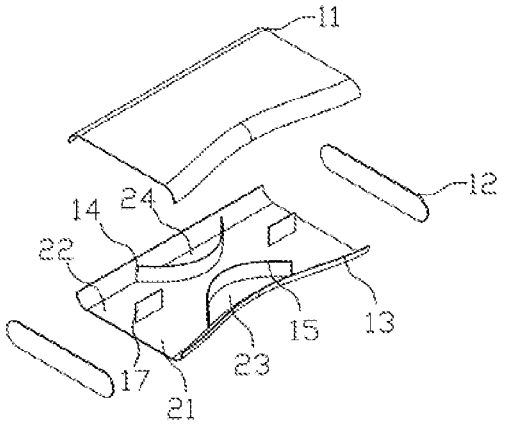
FIG. 5 is the inner structure diagram of the fifth implementation mode for a kind of sleeping pillow complying with the spinal medical theories in the present invention.

FIG. 5 is the inner structure diagram of the fifth implementation mode for a kind of sleeping pillow complying with the spinal medical theories in the present invention. The difference between this implementation mode and the first implementation mode lies in that the connecting cloth 14 and the connecting cloth 15, whose length is shortened, fail to be sewed with the vertical wall 12, and two pieces of horizontally set connecting cloth 17 are added, with other structures the same as those of the first implementation mode, so there will be no repeated description. The sleeping pillow forms standalone face-up sleeping head bearing area 24 and face-up sleeping neck bearing area 23 with the effect of pulling force of the connecting cloth 14 and connecting cloth 15 by connecting the upper layer cloth 11 and lower layer cloth 13, the said face-up sleeping head bearing area 24 and the said face-up sleeping neck bearing area 23 do not contact the vertical wall 12. This structure has reduced difficulty in production and processing and saved costs; the connecting cloth 17 is sewed between the upper layer cloth 11 and the lower layer cloth 13. The pillow case forms the side sleeping head bearing area 22 and the side sleeping neck bearing area 21 via the connecting cloth under the effect of pulling force. The said the side sleeping head bearing area 22 and the said the side sleeping neck bearing area 21 is interpenetrated.

Figure 6:
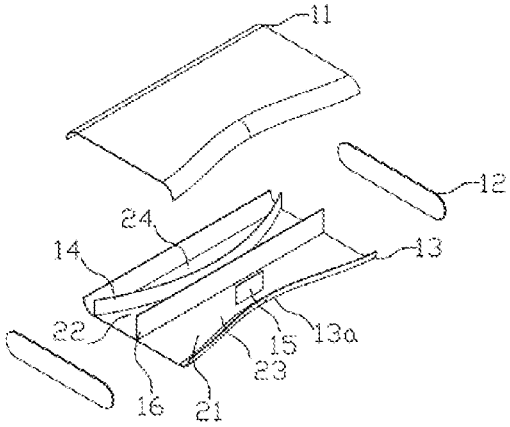
FIG. 6 is the inner structure diagram of the sixth implementation mode for a kind of sleeping pillow complying with the spinal medical theories in the present invention.

FIG. 6 is the inner structure diagram of the sixth implementation mode for a kind of sleeping pillow complying with the spinal medical theories in the present invention. With reference to FIG. 6, the sleeping pillow contains the upper layer cloth 11, lower layer cloth 13, a pair of vertical walls 12 located on both sides of the sleeping pillow. The said vertical walls 12 can ensure the overall shape of both sides of the sleeping pillow. The space enclosed by the said upper layer cloth 11, the lower layer cloth 13 and the vertical wall 12 together is the pillow case. The pillow case is provided with the vertical partition cloth 16 sewed in the upper layer cloth 11, the lower layer cloth 13 and vertical wall 12. The pillow case forms independent head bearing area and neck bearing area with the effect of pulling force of the partition cloth 16. The lower part of the said neck bearing area and the head bearing area are provided with height adjusting cushions, which can be adjusted to a comfortable supporting height as required.

The pillow case is also provided with the connecting cloth 14 and the connecting cloth 15. The said pillow case forms standalone face-up sleeping head bearing area 24 with the effect of pulling force of the connecting cloth 14 and the connecting cloth 15, and interpenetrated face-up sleeping neck bearing area 23 and the side sleeping neck bearing area 21; two sides of the said face-up sleeping head bearing area 24 are interpenetrated side sleeping head bearing area 22, the said face-up sleeping neck bearing area 23 and the side sleeping neck bearing area 21 are interpenetrated.

The said sleeping pillow is in the symmetrical structure, and the abovementioned inner structure design of the sleeping pillow enables fillers of the face-up sleeping area and the side sleeping area to be independent without being interfered with. The most comfortable head bearing area and the neck bearing area can be provided in different sleeping modes; the said face-up sleeping head bearing area 24, the side sleeping head bearing area 22, the side sleeping neck bearing area 21 and or face-up sleeping neck bearing area 23 are provided with zipper openings filled with pocket style adjusting fillers (not shown in the figure). Appropriate amount of fillers can be filled based on different demands to adjust the height of the sleeping pillow and the softness and hardness of the sleeping pillow. While basic physiological curves of human body are ensured, fillers can relax and deform in their respective areas or transfixion areas forming comfortable occipital areas; for the fillers filled in the side sleeping area and the face-up sleeping area, they can be the same kind of fillers, or different kinds of fillers can be selected at different parts as required; the lower side of the sleeping pillow is extracted forming an arc should pad 13*a*. When human body is in the face-up sleeping mode, the sleeping pillow conforms to the physiological structure of human shoulders and neck offering people more comfortable operation experience. Furthermore, this sleeping pillow can also be used as a general inner container.

Figure 7:
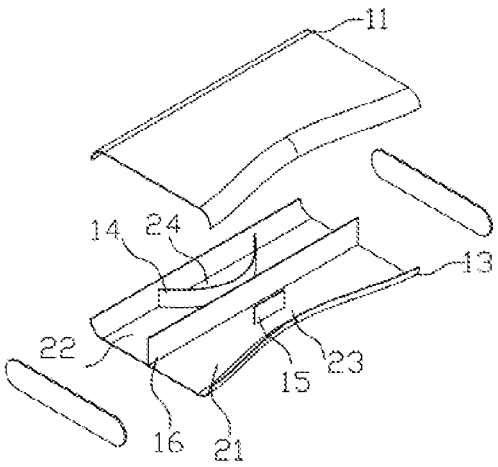
FIG. 7 is the inner structure diagram of the seventh implementation mode for a kind of sleeping pillow complying with the spinal medical theories in the present invention.

FIG. 7 is the inner structure diagram of the seventh implementation mode for a kind of sleeping pillow complying with the spinal medical theories in the present invention. With reference to FIG. 7, the difference between this implementation mode and the sixth implementation mode lies in that the connecting cloth 14 is not sewed with the vertical wall 12, and the face-up sleeping head bearing area 24 does not contact the vertical wall 12, with other structures the same as those of the sixth implementation mode, so there will be no repeated description. In this implementation mode, the pillow case forms independent standalone face-up sleeping head bearing area 24 and the side sleeping head bearing area 22 with the effect of the pulling force of the connecting cloth 14 sewed between the upper layer cloth 11 and the lower layer cloth 13.

Figure 8:
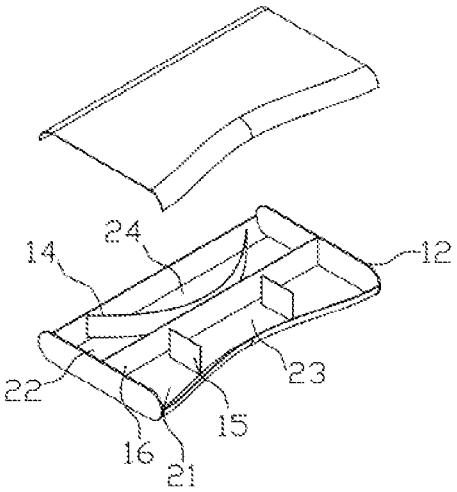
FIG. 8 is the inner structure diagram of the eighth implementation mode for a kind of sleeping pillow complying with the spinal medical theories in the present invention.

FIG. 8 is the inner structure diagram of the eighth implementation mode for a kind of sleeping pillow complying with the spinal medical theories in the present invention. With reference to FIG. 8, the difference between this implementation mode and the sixth implementation mode lies in that the connecting cloth 14 is shortened and does not contact the vertical wall 12. The neck bearing area is provided with two pieces of vertically arranged connecting cloth 15, with other structure the same as that of the sixth implementation mode, so there will be no repeated description. In this implementation mode, the pillow case forms standalone face-up sleeping head bearing area 24 with the effect of pulling force of the connecting cloth 14 and the connecting cloth 15 sewed between the upper layer cloth 11 and the lower layer cloth 13. Both sides of the said face-up sleeping head bearing area 24 are interpenetrated side sleeping head bearing area 22; the connecting cloth 15 is sewed between the upper layer cloth 11 and lower layer cloth 13. The pillow case forms interpenetrated face-up sleeping neck bearing area 23 and the side sleeping neck bearing area 21 with the effect of pulling force of the connecting cloth 15; the connecting cloth 15 as shown in FIG. 8 can also be sewed with vertical partition cloth 16 forming the said implementation mode.

Figure 9:
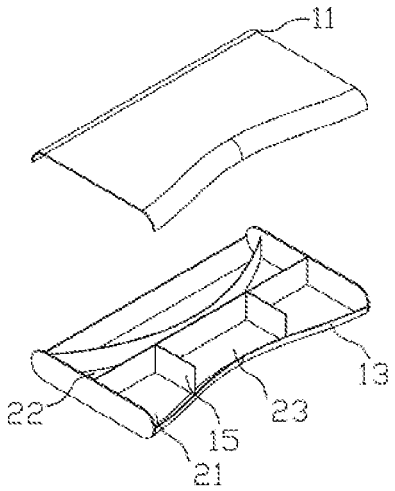
FIG. 9 is the inner structure diagram of the ninth implementation mode for a kind of sleeping pillow complying with the spinal medical theories in the present invention.

FIG. 9 is the inner structure diagram of the ninth implementation mode for a kind of sleeping pillow complying with the spinal medical theories in the present invention. With reference to FIG. 9, the difference between this implementation mode and the sixth implementation mode lies in that the neck bearing area is provided with two pieces of vertically arranged connecting cloth 15, with other structures the same as those of the sixth implementation mode. In this implementation mode, the pillow case forms independent face-up sleeping neck bearing area 23 and the side sleeping neck bearing area 21 via the connecting cloth 15 sewed between the upper layer cloth 11 and the lower layer cloth 13 under the effect of pulling force.

Figure 10:
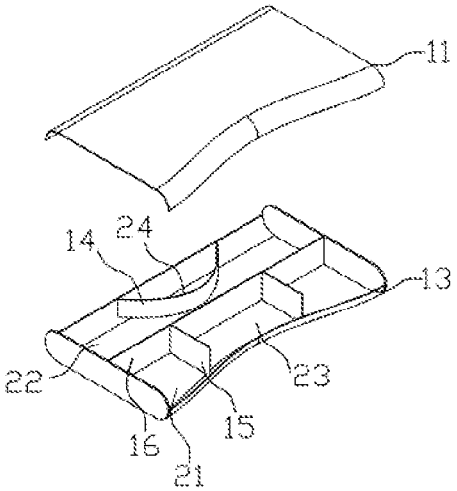
FIG. 10 is the inner structure diagram of the tenth implementation mode for a kind of sleeping pillow complying with the spinal medical theories in the present invention.

FIG. 10 is the inner structure diagram of the tenth implementation mode for a kind of sleeping pillow complying with the spinal medical theories in the present invention. The difference between this implementation mode and that of the sixth implementation mode lies in that the connecting cloth 14 is shortened failing to be sewed with the vertical wall 12, and the face-up sleeping head bearing area 24 does not contact the vertical wall 12. The neck bearing area is provided with two pieces of vertical partition cloth 16 sewed by vertically arranged. The upper layer cloth 11, lower layer cloth 13, and other structures are the same as those of the sixth implementation mode, so there will be no repeated description. In this implementation mode, the pillow case forms independent face-up sleeping head bearing area 24 and the side sleeping head bearing area 22 with the effect of pulling force of the connecting cloth 14 sewed between the upper layer cloth 11 and the lower layer cloth 13; the said pillow case forms independent face-up sleeping neck bearing area 23 and the side sleeping neck bearing area 21 with the effect of pulling force of the connecting cloth 15.

Figure 11:
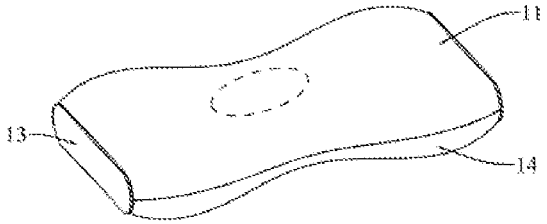
FIG. 11 is the overall diagram of the eleventh implementation mode of a kind of sleeping pillow complying with the spinal medical theories in the present invention.
Figure 12:
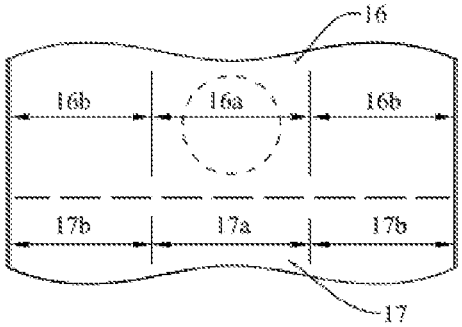
FIG. 12 is the front view of the eleventh implementation mode of a kind of sleeping pillow complying with the spinal medical theories in the present invention.
Figure 13:
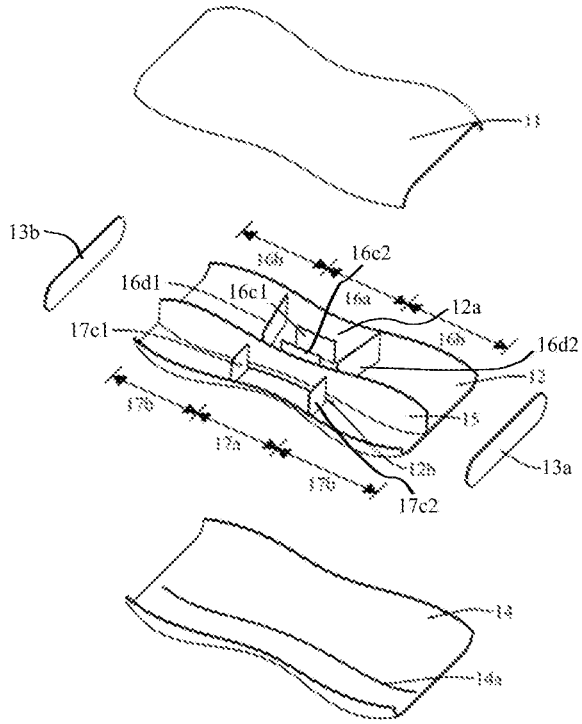
FIG. 13 is the inner structure diagram of the eleventh implementation mode for a kind of sleeping pillow complying with the spinal medical theories in the present invention.

FIGS. 11 to 13 are inner structure diagram of the eleventh implementation mode of a kind of sleeping pillow complying with the spinal medical theories in the present invention. With reference to FIG. 11-FIG. 13, the sleeping pillow includes the pillow case and fillers filled in the pillow case. The pillow case includes upper layer cloth 11, lower layer cloth 12, vertical cloth 13, bottom layer cloth 14 and vertical partition cloth 15. Preferably, fillers are any or several of PE hoses, buckwheat hulls, cassia seeds and silkworm excrement. Of course, other normal materials can also be used.

The upper layer cloth 11 is sewed with the lower layer cloth 12, and the vertical cloth 13 is sewed on both sides of the upper layer cloth 11 and the lower layer cloth 12. The side of partition cloth 15 is respectively sewed with the upper layer cloth 11, vertical cloth 13 and lower layer cloth 12, which separate the space enclosed by upper layer cloth 11 and lower layer cloth 12 into independent head bearing area 16 and neck bearing area 17.

The head bearing area 16 has the face-up sleeping head bearing area 16*a* dented in the middle and the side sleeping head bearing area 16*b* whose both sides are higher; neck bearing area 17 has the face-up sleeping neck bearing area 17*a* set in the middles and the side sleeping neck bearing area 17*b* set on both sides of the face-up sleeping neck bearing area 17*a*. The height of the side sleeping neck bearing area 17*b* is no lower than the face-up sleeping neck bearing area 17*a*. When the sleeping pillow of the present invention is normally used, the height of the side sleeping neck bearing area 17*b* must be higher than the face-up sleeping neck bearing area 17*a*, with two ways for adjusting the heights of the two: one is by the effect of height restriction of the pillow case, that is, the pillow case has a lower sewing height than that of face-up sleeping neck bearing area 17*a*; the other is that you can sew the face-up sleeping neck bearing area 17*a* and the side sleeping neck bearing area 17*b* at the same height, but the saturation of fillers of the two is different. If the way of adjusting height of fillers is used, the heights of different subsections of the pillow case in neck bearing area 17 may be the same. Isolated and independent head bearing area 16 and neck bearing area 17 can effectively avoid movement of fillers between the two in the pillow case to ensure the stability of pillow shape.

What is specially described is that the vertical cloth 13 in this embodiment can be made of single layer cloth, and can be made of multilayer cloth with inside cloth. If it is multilayer cloth, then the inside cloth must be sewed with the vertical partition cloth 15, so there will be no sewing threads in the outer layer of the vertical cloth 13, which ensures the overall beauty of the pillow and the effect on forming and shaping of vertical cloth 13 done by sewing threads.

The head bearing area 16 is used for supporting the head while a person is sleeping. It is provided with several pieces of connecting cloth connecting the upper layer cloth 11 and lower layer cloth 12. The head bearing area 16 forms the face-up sleeping head bearing area 16*a* and the side sleeping head bearing area 16*b* with the effect of pulling force of the connecting cloth. In this implementation mode, connecting cloth includes horizontal connecting cloth 16*c* and vertical connecting cloth 16*d*. Of course, horizontal connecting cloth 16*c* and vertical connecting cloth 16*d* do not have to satisfy the absolute vertical relationships. Only making the upper layer cloth 11 form proper height dent will do.

The connecting cloth of the head bearing area 16 is designed using half open subsection so that inner fillers can move in the supporting area of the face-up sleeping and the side sleeping. This adaptable movement can not only make a person feel comfortable, but also have some massage effect on the scalp.

The neck bearing area 17 is used to support the neck while a person is sleeping. It has at least two pieces of vertical subsection cloth 17*c* that is totally separated or partly separated. The neck bearing area 17 forms the face-up sleeping neck bearing area 17*d* and the side sleeping neck bearing area 17*e* with the pulling force of the vertical subsection cloth 17*c*, in which the face-up sleeping neck bearing area 17*a* corresponds with the face-up sleeping head bearing area 16*a* and the side sleeping neck.

The supporting area 17*b* corresponds with the side sleeping head bearing area 16*b*. If a totally separated structure is used for the vertical subsection cloth 17*c*, then fillers in different neck bearing areas cannot move in the neighboring neck bearing areas so as to ensure the shape of the pillow; if the partly separated structure is used for the vertical subsection cloth 17*c*, then fillers in different neck bearing areas cannot move towards each other. This adaptable movement has helped improve the comfort of the sleeping pillow to some extent.

In order that human head and neck fit the sleeping pillow, the height of the dent center of the face-up sleeping head bearing area 16*a* in the present invention must be lower than that of face-up sleeping neck bearing area 17*a*, while the height of the side sleeping head bearing area 17*a* must be lower than that of the side sleeping neck bearing area 17*b*. Therefore, whether human body is in face-up sleeping or side sleeping state, the present invention can perform adjustment so that the sleeping pillow making body pressure balanced will make human body feel naturally comfortable.

The bottom layer cloth 14 is sewed below the lower layer cloth 12, and is sewed with the vertical cloth 13. The interlayer between the bottom layer cloth 14 and lower layer cloth 12 is used to place height adjusting cushion (not shown in Figure). The height adjusting cushion can make the sleeping pillow suitable to persons with different shoulders to avoid stiff neck or harm to cervical vertebra due to too high or too low a sleeping pillow.

The lower layer cloth 12 is provided the first opening 12*a* with zippers at the location of the head bearing area 16*a*. The first opening 12*a* is used to place fillers towards the head bearing area 16. The neck bearing area 17 is provided with the second opening 12*b* with zippers. The second opening 12*b* is used to place fillers for the neck bearing area 17. The bottom layer cloth 14 is provided with the third opening 14*a* with zippers. The third opening 14*a* is the entry and exit connecting the interior and exterior of the pillow. The design of zipper openings enables the placement and taking out of fillers in the pillow very simple and convenient.

With reference to FIG. 13, the upper layer cloth 11 is sewed with the lower layer cloth 12, and the vertical cloths 13*a* and 13*b* are respectively sewed on both sides of each of the upper layer cloth 11 and the lower layer cloth 12. A height of each of two sides of the vertical partition cloth 15 in contact with the vertical cloths 13*a* or 13*b* is higher than a height of a middle of the vertical partition cloth 15, so that a shape of the vertical partition cloth 15 is wavy. The vertical partition cloth 15 separates the space enclosed by upper layer cloth 11 and lower layer cloth 12 into the head bearing area 16 and the neck bearing area 17 that are independent of each other. Moreover, an area of the head bearing area 16 is larger than an area of the neck bearing area 17.

In the present embodiment, a number of the horizontal connecting cloth 16*c* can be at least one, and preferably be two or more (i.e., the second connecting cloths 16*c*1, 16*c*2 as shown in FIG. 13), and a number of the vertical connecting cloth 16*d* can be two (i.e., the first connecting cloths 16*d*1, 16*d*2 as shown in FIG. 13). Moreover, the first connecting cloths 16*d*1, 16*d*2 can be not parallel to each other. A height of the horizontal connecting cloth 16*c*1 is higher than a height of the horizontal connecting cloth 16*c*2. A height of each of the first connecting cloths 16*d*1, 16*d*2 is the same. In addition, the height of each of the first connecting cloths 16*d*1, 16*d*2 is higher than the height of the horizontal connecting cloth 16*c*1.

As mentioned above, the head bearing area 16 is used for supporting the head while the person is sleeping. The head bearing area 16 includes the first connecting cloths 16*d*1 and 16*d*2 that are not parallel to each other, and each of the first connecting cloths 16*d*1 and 16*d*2 is not in contact with the vertical partition cloth 15. Since each of the first connecting cloths 16*d*1 and 16*d*2 partially separates the head bearing area 16 to form the face-up sleeping head bearing area 16*a* and the side sleeping head bearing area 16*b*, both of face-up sleeping head bearing area 16*a* and the side sleeping head bearing area 16*b* are semi-enclosed.

As mentioned above, the neck bearing area 17 is used to support the neck while the person is sleeping. In the present embodiment, a number of the vertical subsection cloth 17*c* can be two (i.e., the third connecting cloths 17*c*1, 17*c*2 as shown in FIG. 13). The third connecting cloths 17*c*1 and 17*c*2 are parallel to each other and each of the third connecting cloths 17*c*1 and 17*c*2 is in contact with the vertical partition cloth 15. Since each of the third connecting cloths 17*c*1 and 17*c*2 totally separates the neck bearing area 17, the face-up sleeping neck bearing area 17*a* and the side sleeping neck bearing area 17*b* are totally enclosed.

In addition, a height of each of the third connecting cloths 17*c*1, 17*c*2 is the same and the height of each of the third connecting cloths 17*c*1, 17*c*2 is higher than the height of each of the first connecting cloths 16*d*1, 16*d*2.

What is specially described is that the bottom layer cloth 14 and the vertical cloth 13 is not the cloth layer that must have. There are two roles of the bottom layer cloth 14: one is sewed with the lower layer cloth 12 forming the interlayer used to place height adjusting cushion; the other is to avoid too many openings to be exposed on the outside of the sleeping pillow to ensure the overall elegance of it. The vertical cloth 13 can make the overall dimensional elegance of the sleeping pillow and make the sleeping pillow closer to the physiological curves of human head and neck.

For the fillers filled in the head bearing area 16 and the neck bearing area 17, the same kind of fillers can be used, or different kinds of fillers can be selected for different parts as required.

Figure 14:
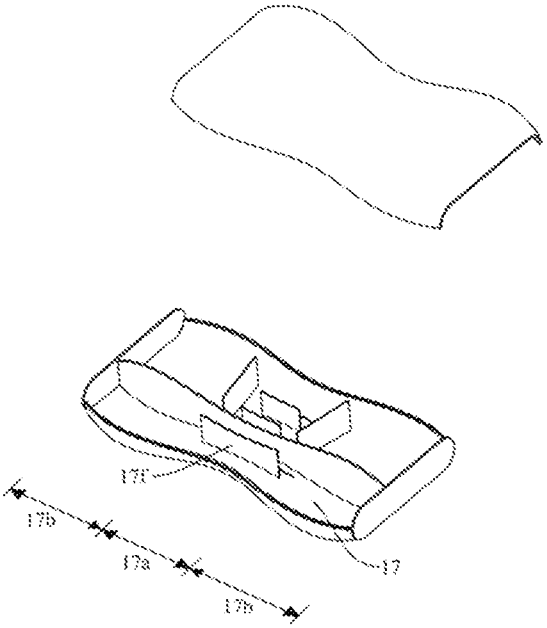
FIG. 14 is the inner structure diagram of the twelfth implementation mode for a kind of sleeping pillow complying with the spinal medical theories in the present invention.

FIG. 14 is the specific structure diagram of the twelfth implementation mode for a kind of sleeping pillow complying with the spinal medical theories in the present invention. The difference between this implementation mode and the first implementation mode lies in that different structures are applied to the subsection cloth in the neck bearing area 17, with other structures the same as those of the first implementation mode, so there will be no repeated description. In this implementation mode, the neck bearing area 17 is provided with a piece of horizontal subsection cloth 17*f* The neck bearing area 17 forms the face-up sleeping neck bearing area 17*a* and the side sleeping neck bearing area 17*b* with the pulling force of this horizontal subsection cloth 17*f*. The length and height of the horizontal subsection cloth 17*f* can be flexibly set according to the specific shape of the sleeping pillow.

Figure 15:
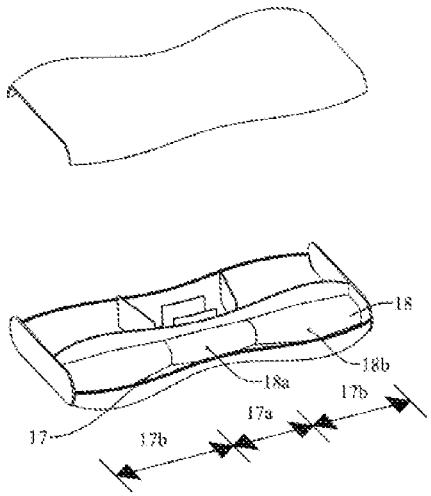
FIG. 15 is the inner structure diagram of the thirteenth implementation mode for a kind of sleeping pillow complying with the spinal medical theories in the present invention.

FIG. 15 is the specific structure of the thirteenth implementation mode for a kind of sleeping pillow complying with the spinal medical theories in the present invention. The difference between this implementation mode and the first implementation mode lies in that different structures are applied to the neck bearing area 17, with other structures the same as those of the first implementation mode, so there will be no repeated description. In this implementation mode, the neck bearing area 17 is not provided with vertical subsection cloth, but directly provided with the neck support bag 18. Such neck support bag 18 is divided into the face-up sleeping neck support section 18*a* in the middle and the side sleeping neck support section 18*b* on two sides. The height of the side sleeping neck support section 18*b* is no lower than the face-up sleeping neck support section 18*a*. The face-up sleeping neck support section 18*a* corresponds with the face-up sleeping neck bearing area 17*a*, while the side sleeping neck support section 18*b* corresponds with the supporting 17*b* area of the side sleeping neck.

Further, face-up sleeping neck support section 18*a* and the side sleeping neck support section 18*b* is provided with the support bag opening with zippers. The support bag opening is used to be provided with fillers in the neck support bag 18. Preferably, the category of fillers must be the same as those in the head bearing area.

Figure 16:
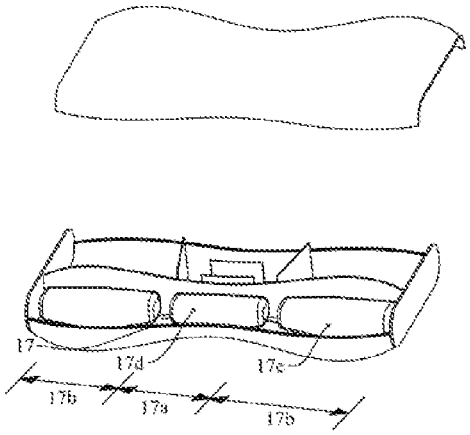
FIG. 16 is the inner structure diagram of the fourteenth implementation mode for a kind of sleeping pillow complying with the spinal medical theories in the present invention.

FIG. 16 is the specific structure of the fourteenth implementation mode for a kind of sleeping pillow complying with the spinal medical theories in the present invention. The difference between this implementation mode and the first implementation mode lies in that the structure of its neck bearing area 17 is different. In this implementation mode, the face-up sleeping neck bearing area 17*a* in the neck bearing area 17 is provided with the face-up sleeping neck support unit 17*d*, and the side sleeping neck bearing area 17*b* is provided with the side sleeping neck support unit 17*e*. The height of the side sleeping neck support unit 17*e* is no lower than the face-up sleeping neck support unit 17*d*. As a matter of fact, the nature of this implementation mode is to divide the neck support bag in the second implementation mode into standalone three parts and put into the neck bearing area 17.

Figure 17:
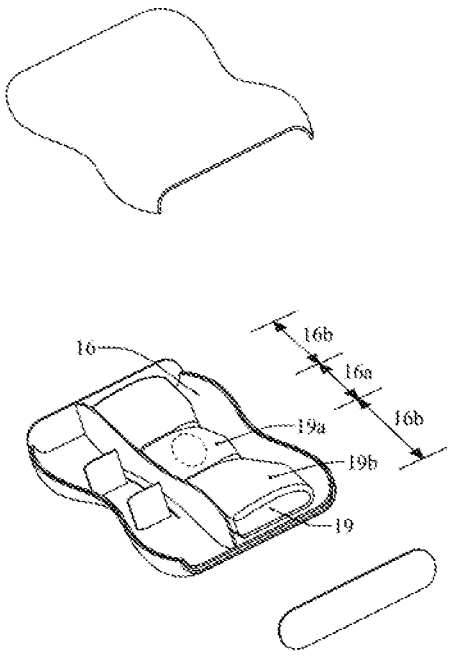
FIG. 17 is the inner structure diagram of the fifteenth implementation mode for a kind of sleeping pillow complying with the spinal medical theories in the present invention.

FIG. 17 is the specific structure of the fifteenth implementation mode for a kind of sleeping pillow complying with the spinal medical theories in the present invention. The difference between this implementation mode and the first implementation mode lies in that different structures are applied to the head bearing area 16, with other structures the same as those of the first implementation mode. In this implementation mode, the head bearing area 16 is provided with the head support bag 19. This head support bag 19 has the face-up sleeping head support section 19*a* dented in the middle and the side sleeping head support section 19*b* whose both sides are higher. The face-up sleeping head support section 19*a* corresponds with the face-up sleeping head bearing area 16*a*, and the side sleeping head support section 19*b* corresponds with the side sleeping head bearing area 16*b*. The interior of the head support bag 19 forms dents in the middle of the head support bag 19 by also depending on the pulling force of several pieces of connecting cloth. The interior of the head support bag 19 is provided with fillers.

Figure 18:
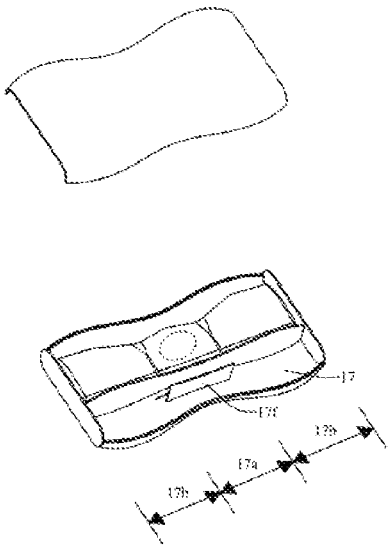
FIG. 18 is the inner structure diagram of the sixteenth implementation mode for a kind of sleeping pillow complying with the spinal medical theories in the present invention.

FIG. 18 is the specific structure of the sixteenth implementation mode for a kind of sleeping pillow complying with the spinal medical theories in the present invention. The difference between this implementation mode and the fifth implementation mode lies in that the subsection cloth structure of the neck bearing area 17 is different. The neck bearing area 17 in this implementation mode is the same as the structure of the neck bearing area in the second implementation mode as shown in FIG. 4, the pulling force of one piece of horizontal subsection cloth 17*f* is used to divide the neck bearing area 17 into the face-up sleeping neck bearing area 17*a* dented in the middle and the side sleeping neck bearing area 17*b* whose both sides are higher.

Figure 19:
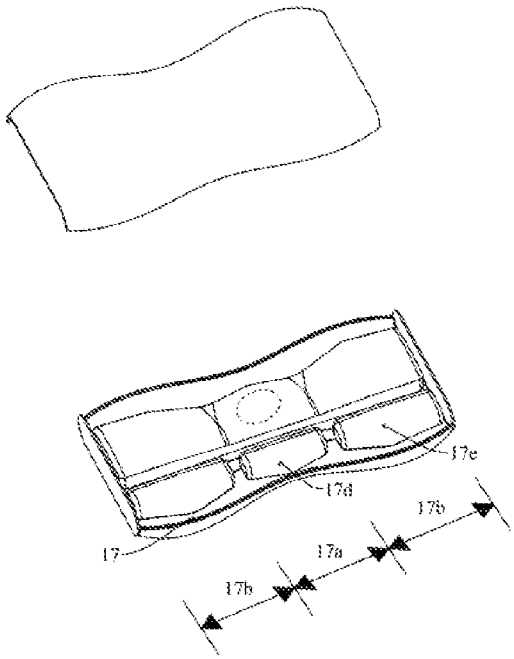
FIG. 19 is the inner structure diagram of the seventeenth implementation mode for a kind of sleeping pillow complying with the spinal medical theories in the present invention.

FIG. 19 is the specific structure seventeenth implementation mode for a kind of sleeping pillow complying with the spinal medical theories in the present invention. The difference between this implementation mode and the fifth implementation mode lies in that the structures of the neck bearing area 17 are different. The neck bearing area 17 in this implementation mode is the same as the structure of the neck bearing area in the fourth implementation mode as shown in FIG. 6, the face-up sleeping neck bearing area 17*a* is provided with the face-up sleeping neck support unit 17*d*. The side sleeping neck bearing area 17*b* is provided with the side sleeping neck support unit 17*e*. The height of the side sleeping neck support unit 17*e* is no lower than the face-up sleeping neck support unit 17*d*.

Figure 20:
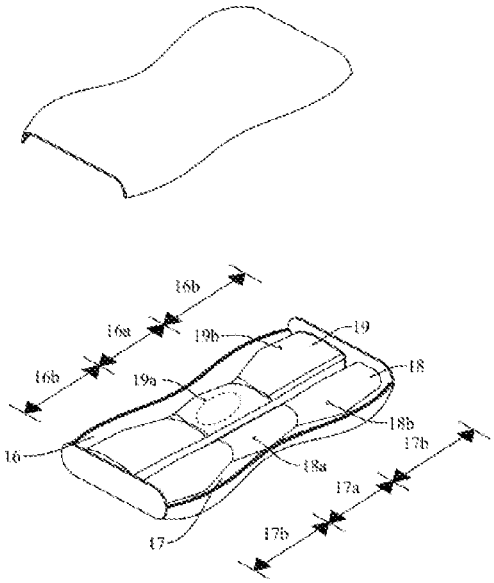
FIG. 20 is the inner structure diagram of the eighteenth implementation mode for a kind of sleeping pillow complying with the spinal medical theories in the present invention.

FIG. 20 is the specific structure of the eighteenth implementation mode for a kind of sleeping pillow complying with the spinal medical theories in the present invention. In this implementation mode, the head bearing area 16 is provided with standalone head support bag 19, while neck bearing area 17 is provided with standalone neck support bag 18. As the head support bag 19 and the neck support bag 18 are independent, no vertical partition cloth is required to be set between the head bearing area 16 and neck bearing area 17. Specifically, head support bag 19's face-up sleeping head support section 19*a* corresponds with the face-up sleeping head bearing area 16*a*. The side sleeping head support section 19*b* corresponds with the side sleeping head bearing area 16*b*; the face-up sleeping neck support section 18*a* of the neck support bag 18 corresponds with the face-up sleeping neck bearing area 17*a*; the side sleeping neck support section 18*b* corresponds with the side sleeping neck bearing area 17*b*.

What is mentioned above is the specific description of better embodiments in the present invention, but the present invention will not limit the said embodiments. Technicians familiar with this field can also make kinds of equivalent changes in shapes or replacements without betrayal to the essence of the present invention. Such equivalent changes in shapes or replacements are all included in the range limited by this patent claim.

What is claimed is:

1. A pillow comprising:

a pillow case having an upper layer cloth and a lower layer cloth;

a partition cloth;

two first connecting cloths;

at least one second connecting cloth; and two third connecting cloths;

wherein the upper layer cloth is sewed with the lower layer cloth to define a enclosed space that is enclosed by the upper layer cloth and the lower layer cloth;

wherein a filler is disposed in the enclosed space;

wherein the partition cloth is disposed in the enclosed space, and the partition cloth separates the enclosed space into a head-bearing area and a neck-bearing area;

wherein an area of the head bearing area is larger than an area of the neck bearing area;

wherein the two first connecting cloths and the at least one second connecting cloth are positioned in the head bearing area, and the two third connecting cloths are positioned on the neck bearing area;

wherein each of the two first connecting cloths and the at least one second connecting cloth joins to the upper layer cloth and to the lower layer cloth to define, within the enclosed space, a face-up-sleeping head-bearing area and a side-sleeping head-bearing area at each of two sides of the pillow case, and each of the two third connecting cloths joins to the upper layer cloth and to the lower layer cloth to define, within the enclosed space, a face-up-sleeping neck-bearing area and a side-sleeping neck-bearing area at each of the two sides of the pillow case;

wherein the pillow is configured to be dented in a middle such that the side-sleeping head-bearing areas are higher than the face-up-sleeping head-bearing areas, and the side-sleeping neck-bearing areas are no lower than the face-up-sleeping neck-bearing area;

wherein a side of the neck-bearing area is configured to form a radian shoulder pad;

wherein the two first connecting cloths partially separate the head bearing area to form the face-up sleeping head bearing area and the side sleeping head bearing area, so that the head bearing area is semi-enclosed;

wherein the two third connecting cloths separate the neck bearing area to form the face-up sleeping neck bearing area, so that the side sleeping neck bearing area are enclosed.

2. The pillow of claim 1, further comprising: a head support bag in the head bearing area, the head support bag having a middle section and side sections, wherein the side sections are higher than the middle section.

3. The pillow of claim 1, wherein the height of each side of the partition cloth is higher than a height of a middle of the partition cloth, so that a shape of the partition cloth is wavy.

4. The pillow of claim 1, wherein a height of each of the two third connecting cloths is the same, and the height of the third connecting cloth is higher than a height of each of the two first connecting cloths.

5. The pillow of claim 4, wherein the height of each of the two first connecting cloths is the same, and the height of the first connecting cloth is higher than a height of the at least one second connecting cloth.

6. The pillow of claim 1, wherein the pillow case further includes two vertical cloths, wherein the upper layer cloth is sewed with the lower layer cloth, and each of the two vertical cloths is respectively sewed on both sides of each of the upper layer cloth.

* * * * *